US009163889B2

(12) United States Patent
Constant et al.

(10) Patent No.: US 9,163,889 B2
(45) Date of Patent: Oct. 20, 2015

(54) RECEIVER ASSEMBLY FOR FIREARM

(71) Applicant: Smith & Wesson Corp., Springfield, MA (US)

(72) Inventors: Robert L. Constant, Westfield, MA (US); Richard A. Picard, Ludlow, MA (US); John Pliska, Hadley, MA (US)

(73) Assignee: Smith & Wesson Corp., Springfield, MA (US)

( * ) Notice: Subject to any disclaimer, the term of this patent is extended or adjusted under 35 U.S.C. 154(b) by 4 days.

(21) Appl. No.: 14/336,092

(22) Filed: Jul. 21, 2014

(65) Prior Publication Data

US 2015/0247689 A1 Sep. 3, 2015

Related U.S. Application Data

(62) Division of application No. 13/274,887, filed on Oct. 17, 2011, now Pat. No. 8,782,939, which is a division of application No. 11/972,018, filed on Jan. 10, 2008.

(60) Provisional application No. 60/884,246, filed on Jan. 10, 2007, provisional application No. 60/884,268, filed on Jan. 10, 2007, provisional application No. 60/908,488, filed on Mar. 28, 2007.

(51) Int. Cl.

| | |
|---|---|
| ***F41A 19/00*** | (2006.01) |
| ***F41A 3/66*** | (2006.01) |
| ***F41A 3/12*** | (2006.01) |

(52) U.S. Cl.

CPC .... *F41A 3/66* (2013.01); *F41A 3/12* (2013.01)

(58) Field of Classification Search

USPC ..... 42/69.01, 75.02, 75.01

See application file for complete search history.

(56) References Cited

U.S. PATENT DOCUMENTS

| | | | |
|---|---|---|---|
| 1,580,968 | A | 4/1926 | Di Brazza |
| 2,345,833 | A | 4/1944 | Schirokaner |
| 2,423,854 | A | 7/1947 | Simpson |
| 3,708,841 | A | 1/1973 | Quinney |
| 3,742,638 | A | 7/1973 | Archer |
| 3,877,167 | A | 4/1975 | Keppeler |
| 3,883,977 | A | 5/1975 | McClure |
| 4,447,975 | A | 5/1984 | Ljutic |
| 4,791,748 | A | 12/1988 | Leskinen |
| 4,918,825 | A | 4/1990 | Lesh et al. |
| 5,020,260 | A | 6/1991 | Houghton |
| 5,133,142 | A | 7/1992 | Peters |
| 5,410,834 | A | 5/1995 | Benton et al. |
| 5,900,577 | A | 5/1999 | Robinson et al. |
| 5,987,797 | A | 11/1999 | Dustin |
| 6,205,696 | B1 | 3/2001 | Bilgeri |
| 6,609,323 | B1 | 8/2003 | Donnelly |
| 6,622,609 | B1 | 9/2003 | Barkan |
| 7,451,564 | B2 | 11/2008 | Walt |

(Continued)

OTHER PUBLICATIONS

KTOG, Kel Tec Owners Group Forum, Dec. 2005 (http://www.thektog.org/forum/f88/size-diameter-crush-washer-muzzle-break-227885/).*

*Primary Examiner* — Michelle Clement
(74) *Attorney, Agent, or Firm* — Ballard Spahr LLP

(57) ABSTRACT

A receiver assembly includes a bolt, a receiver having a threaded portion receiving a barrel, a barrel having a threaded portion engaged with the threaded portion of the receiver, and a crush washer positioned over the threaded portions between the barrel and the receiver to permit adjustment of the barrel relative to the receiver to achieve a proper headspacing.

7 Claims, 8 Drawing Sheets

(56) References Cited

U.S. PATENT DOCUMENTS

| | | | |
|---|---|---|---|
| 7,574,823 | B2 | 8/2009 | Nakayama |
| 7,587,853 | B2 | 9/2009 | Aalto |
| 7,596,900 | B2 | 10/2009 | Robinson et al. |
| D610,218 | S | 2/2010 | Barrett |
| 7,681,483 | B1 | 3/2010 | Rhoades et al. |
| 7,735,252 | B1 | 6/2010 | Laney et al. |
| 7,779,572 | B2 | 8/2010 | Potterfield et al. |
| 7,810,271 | B2 | 10/2010 | Patel |
| 7,942,090 | B1 | 5/2011 | Hoffman |
| 7,950,177 | B2 | 5/2011 | Laney et al. |
| 7,975,417 | B2 | 7/2011 | Duplessis et al. |
| 8,028,458 | B2 | 10/2011 | Rohrauer |
| 8,230,633 | B1 | 7/2012 | Sisk |
| 8,316,570 | B2 | 11/2012 | Potterfield et al. |
| 2005/0188591 | A1 | 9/2005 | Stone |
| 2006/0156606 | A1 | 7/2006 | Robinson et al. |
| 2007/0186458 | A1 | 8/2007 | Walt |
| 2008/0168695 | A1 | 7/2008 | Nakayama |
| 2009/0031605 | A1 | 2/2009 | robinson |
| 2010/0170129 | A1 | 7/2010 | Curry |
| 2010/0175290 | A1 | 7/2010 | Duplessis et al. |
| 2010/0236395 | A1 | 9/2010 | Akhavan |
| 2010/0307042 | A1 | 12/2010 | Jarboe et al. |
| 2012/0216439 | A1 | 8/2012 | Barrett et al. |

* cited by examiner

RECEIVER ASSEMBLY FOR FIREARM

CROSS REFERENCE TO RELATED APPLICATIONS

This application is a divisional of U.S. application Ser. No. 13/274,887, filed Oct. 17, 2011 and issued on Jul. 22, 2014 as U.S. Pat. No. 8,782,939, which is a divisional of U.S. application Ser. No. 11/972,018, filed Jan. 10, 2008, which claims the benefit of: U.S. Provisional Application No. 60/884,246, filed on Jan. 10, 2007; U.S. Provisional Application No. 60/884,268, filed on Jan. 10, 2007; and U.S. Provisional Application No. 60/908,488, filed on Mar. 28, 2007, all of which are herein incorporated by reference in their entirety.

FIELD OF THE INVENTION

The present invention relates to several improvements in a bolt-action firearm and its method of assembly. More particularly, it relates to a firearm having a two-piece bolt, an improved takedown assembly, an improved scope mount, and a buttonless stop. In addition, the present invention relates more specifically to a method of assembling a bolt-action rifle in which the proper headspace can be determined, adjusted, and fixed without disassembling the rifle.

BACKGROUND OF THE INVENTION

Bolt-action firearms are well known in the art. Typically, a cartridge is fed into the receiver from an internal magazine by the forward movement of a bolt. After the shot is fired, the bolt is retracted, which removes the spent casing. The rearward movement of the bolt is limited by a stop machined into the bolt.

However, current bolt designs have several limitations. Primarily, the extension is typically brazed on and encompasses only a small portion of the circumference of the bolt. Both of these factors limit the bolt's strength. In an effort to overcome this problem, attempts have been made to manufacture a one-piece bolt with the extension. This solution suffers from rendering the bolt extremely expensive given the amount of machining required to fabricate the bolt.

Another issue with current bolt designs is the takedown assembly. Known designs make it awkward to remove the bolt. In addition, current scope mounts do not have the unique features of the present invention.

The headspace of a bolt-action rifle is the distance between the face of the closed rifle bolt to the surface in the chamber on which the cartridge case seats.

Headspace ranges are established by industry advisory bodies, government bodies, or by individual manufacturers. In the United States, the primary advisory body is the Small Arms and Ammunition Manufacturers Institute.

In the manufacture of bolt-action rifles, headspace is measured after the firearm has been assembled. If the headspace is not within the specified range, the firearm must in many cases be disassembled and the headspace then adjusted. This process is laborious, time consuming, and slows the production of such rifles.

In view of the above, there is a need for an improved bolt design and scope mounts for a bolt-action firearm as well as a method of assembling a bolt-action rifle where the headspace may be determined, adjusted, and fixed prior to disassembling the rifle. The present invention fulfills these needs and more.

SUMMARY OF THE INVENTION

The invention concerns a firearm. In one example embodiment, the firearm comprises a stock and a receiver mounted on the stock. The receiver has a threaded portion at a forward end thereof. A barrel is affixed to the forward end of the receiver. The barrel has a threaded portion engaged with the threaded portion of the receiver. A crush washer is located between the barrel and the receiver. The barrel is threadedly adjustable about the crush washer.

In a particular example embodiment, the crush washer has a recoil lug. In another example embodiment, the crush washer is compressed and deformed between the barrel and the receiver. By way of example, the threaded portion of the barrel comprises external threads.

The invention further encompasses a receiver assembly for a firearm. In one example embodiment, the receiver assembly comprises a threaded portion at a forward end thereof. A barrel is affixed to the forward end of the receiver. The barrel has a threaded portion engaged with the threaded portion of the receiver. A crush washer is located between the barrel and the receiver. The barrel is threadedly adjustable about the crush washer.

In a particular example embodiment, the crush washer has a recoil lug. By way of further example, the crush washer is compressed and deformed between the barrel and the receiver. In an example embodiment the threaded portion of the barrel comprises external threads. An example embodiment further comprises a bolt movably mounted on the receiver.

OBJECTS OF THE INVENTION

An object of the present invention is to provide a bolt-action firearm in which the bolt is machined as a rearward part that has an outwardly extending handle and an interior part that is axially displaceable. Then, in its finished form, the bolt is brazed as a single piece.

Another object of the present invention is to increase the strength of the joint between the bolt handle and the bolt.

Still another object of the present invention is to decrease the fabrication cost and assembly time of an improved bolt.

Yet another object of the present invention is to have a takedown assembly, which allows a bolt to be easily removed without any parts being misplaced.

Yet another object of the present invention is to provide a scope mount with a superior design that allows it to be mounted over a receiver without blocking the opening for the cartridge feed.

It is another object of the present invention to provide a method of assembling a firearm in which the proper headspace can be determined, adjusted, and fixed without disassembling the firearm.

It is another object of the present invention to provide a method of assembling a bolt-action firearm in which the proper headspace can be determined, adjusted, and fixed without disassembling the firearm.

It is yet another object of the present invention to provide a buttonless stop for a bolt-action firearm.

It is another object of the present invention to provide a simplified bolt stop with fewer components than known bolt stops.

It is an additional object the present invention to decrease fabrication costs and assembly time associated with known bolt stops.

It is yet another object of the present invention to provide a simplified bolt stop and to decrease the fabrication cost and assembly time associated with known bolt stops by providing a buttonless stop.

It is a further object of the present invention to provide a buttonless stop in which a bolt may be retracted and removed from a firearm through the interaction between a channel machined in the bolt and a sear surface of the firearm.

According to one embodiment of the present invention, a bolt for a bolt-action firearm includes a main body with a bolt front end, an opposing end, and an outer surface. The main body has an interior flange at the opposing end that is recessed from the outer surface of the main body and stands proud from the opposing end. A supplemental body is joined to the main body by a joint between the interior flange and a corresponding recess on the supplemental body. The supplemental body also has an integrally formed bolt handle.

According to another embodiment of the present invention, a takedown system for a bolt-action firearm includes a bolt having a circumference enclosed within a receiver of the firearm and a rod operably mounted within the receiver and in substantial touching relationship with the bolt. A pin is mounted to the receiver and connected to the rod with a spring attached to an end of the rod. The rod contains a recessed area that matches the circumference of the bolt so that the bolt can be rearwardly removed from the receiver when the rod is depressed and remains in place when the spring is in a relaxed position.

According to yet another embodiment of the present invention, a scope mount for a bolt-action firearm, where the firearm has a receiver with a top surface adapted to receive the scope mount and an ejection port substantially on a side of the receiver, includes a base having an attachment means for removably affixing to the receiver of the firearm. The base has two ends astride of the ejection port and a central region in substantial registration with the ejection port. The central region has a geometry configured to allow a cartridge to be inserted into and ejected from the ejection port.

According to still another embodiment of the present invention, a bolt-action firearm includes a receiver adapted to be received by a firearm stock and having a threaded portion. A barrel is affixed at a forward end of the receiver and has a corresponding threaded portion. A crush washer is located between the barrel and the receiver so that the barrel is threadedly adjustable about the crush washer.

According to another embodiment of the present invention, a method of assembling a firearm includes the steps of: (1) providing a barrel with a threaded portion at one end and a barrel chamber capable of seating a cartridge, (2) fitting a crush washer over the threaded portion of the barrel, (3) inserting the threaded portion of the barrel into a corresponding threaded portion of a receiver, wherein a bolt with a face is enclosed within the receiver and is adapted to travel in an open and closed position within the receiver, and (4) adjusting the barrel about the crush washer until a desired headspace is achieved, wherein the headspace is the distance between the face of the bolt in a closed position and the barrel chamber on which the cartridge seats.

According to another embodiment of the present invention, a bolt with a buttonless stop for a bolt-action firearm, where the bolt has an outer surface, includes a bolt enclosed within a receiver of the firearm and the bolt has a first channel section, a second channel section, and a third channel section on the outer surface of the bolt. An upper portion of a sear of the firearm engages the channel sections to guide the movement of the bolt. The first channel section is generally perpendicular to a bolt axis of the firearm and terminates in a stop. The second channel section is connected to the first channel section and is generally perpendicular to the first channel section. The third channel section is connected to the second channel section, is generally perpendicular to the second channel section, is generally parallel to the first channel section, and does not have a stop.

According to another embodiment of the present invention, a bolt-action firearm includes a stock, a receiver mounted in the stock, a trigger assembly mounted in the receiver, a barrel located at a forward end of the receiver, and a bolt enclosed within the receiver and adapted to travel forward and rearward within the receiver. The bolt includes a main body with a bolt front end, an opposing end, and an outer surface. The main body has an interior flange at the opposing end that is recessed from the outer surface of the main body and stands proud from the opposing end. A supplemental body is joined to the main body by a joint between the interior flange and a corresponding recess on the supplemental body. The supplemental body also has an integrally formed bolt handle.

According to another embodiment of the present invention, a bolt-action firearm includes a stock, a receiver mounted in the stock, a trigger assembly mounted in the receiver, a barrel located at a forward end of the receiver, and a bolt with an outer surface enclosed within the receiver and adapted to travel forward and rearward within the receiver. The bolt has a first channel section, a second channel section, and a third channel section on the outer surface of the bolt. An upper portion of a sear of the firearm engages the channel sections to guide the movement of the bolt. The first channel section is generally perpendicular to a bolt axis of the firearm and terminates in a stop. The second channel section is connected to the first channel section and is generally perpendicular to the first channel section. The third channel section is connected to the second channel section, is generally perpendicular to the second channel section, is generally parallel to the first channel section, and does not have a stop.

These and other objects of the present invention, and their preferred embodiments, shall become clear by consideration of the specification, claims, and drawings taken as a whole.

DETAILED DESCRIPTION OF THE PREFERRED EMBODIMENT

A typical bolt-action firearm includes a stock, a receiver mounted in the stock, a trigger assembly mounted in the receiver, a barrel located at a forward end of the receiver, and a bolt enclosed within the receiver and adapted to travel forward and rearward within the receiver.

Figure 1:
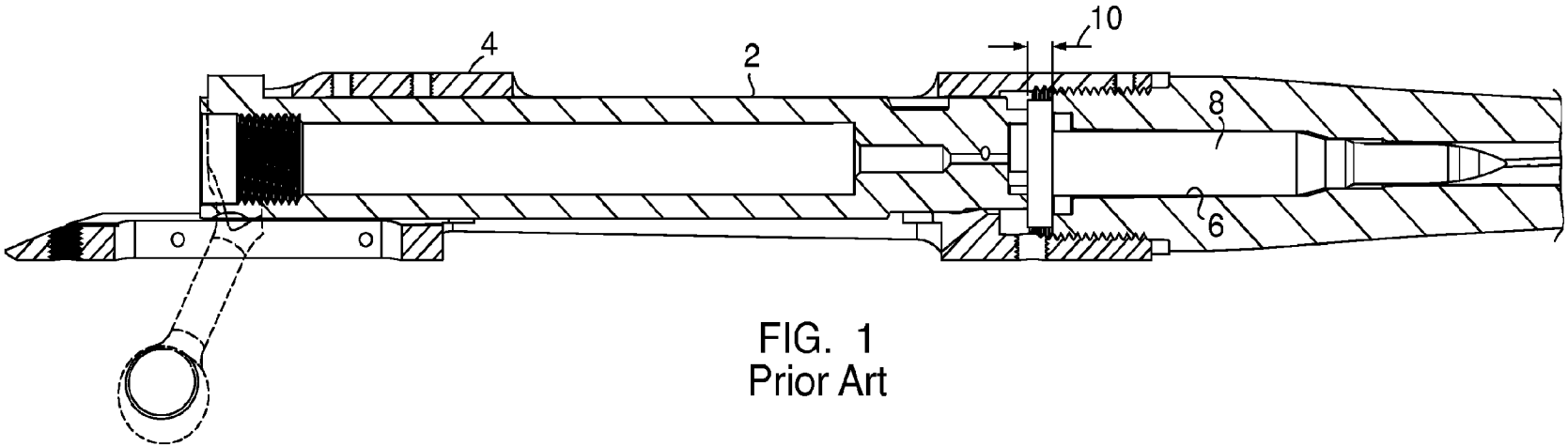
FIG. 1 Prior Art
FIG. 1 is a cut away view of a prior art bolt-action rifle illustrating the headspace of the rifle.

FIG. 1 illustrates the interaction of the various components that create the headspace of a prior art bolt-action rifle. More specifically, FIG. 1 shows a bolt 2 in a closed position, a receiver 4, and a barrel chamber 6 with a cartridge 8 seated in the chamber. The headspace 10 is the distance between the face of the bolt 2 and the portion of the barrel chamber 6 on which the cartridge case 8 seats. As mentioned above, when such rifles are assembled, the headspace is measured and then, if adjustments are necessary, the rifles are disassembled to modify the distance the barrel extends into the receiver. As will be appreciated, this process is not particularly efficient since it requires multiple assemblies of the rifle.

Figure 2:
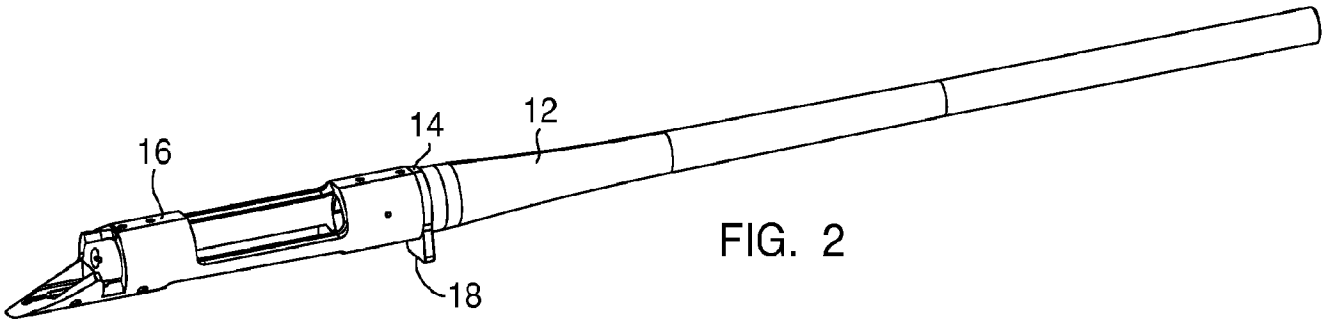
FIG. 2 is a perspective view of a barrel and receiver assembled according to a method of the present invention.

Turning to FIG. 2, the preferred embodiment of the present method addresses this problem through the addition of a crush washer 14. The crush washer 14 is placed between a barrel 12 and a receiver 16. During assembly, the barrel 12 is threaded into the receiver 16. After a bolt is assembled, the headspace is measured. If the headspace needs adjustment, the barrel 12 may be tightened or loosened about the crush washer 14, thereby varying the distance between the face of the bolt and the face of the barrel 12 chamber in which a cartridge seats.

The crush washer 14 is an important aspect of the present invention as it allows the headspace to be adjusted without disassembling the rifle. This in turn reduces the amount of time required to assemble a bolt-action rifle and increases the efficiency of the manufacturing process.

Figure 3:
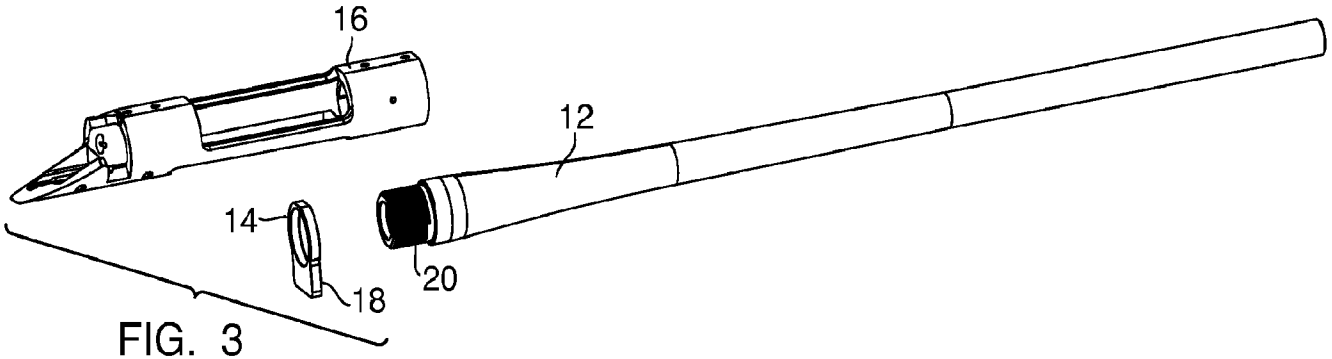
FIG. 3 is an exploded view of the barrel of FIG. 2 illustrating a washer of the present invention.

FIG. 3 shows the individual components of the inventive method. As shown, the barrel 12 has an end with a threaded portion 20. The crush washer 14 fits over the threaded end 20 of the barrel 12. The threaded end of the barrel 12 is then inserted into a corresponding threaded portion of the receiver 16. In a preferred embodiment, the crush washer 14 has a recoil lug 18, which extends from a bottom portion of the washer 14. The recoil lug 18 reduces the movement of the barrel 12 and receiver 16 in the stock of the rifle upon discharge.

Figure 4:
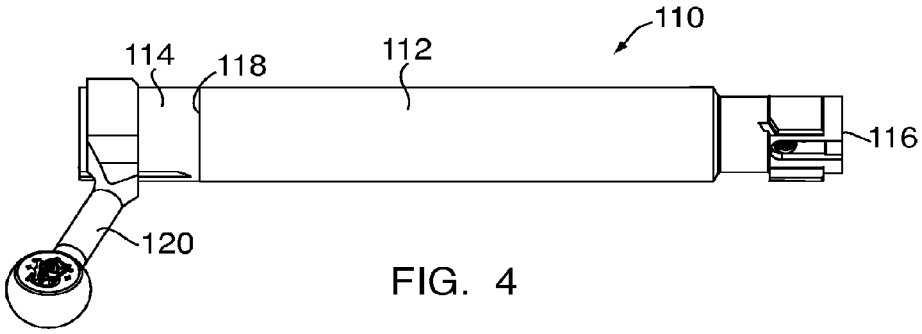
FIG. 4 is a simplified schematic side view of a two-piece bolt provided in accordance with the present invention.

FIG. 4 shows one embodiment of the present invention in a simplified schematic form. Specifically, it shows a two-piece bolt. In FIG. 4, a bolt 110 has a first member (or main body) 112 and a second member (or supplemental body) 114. The first member 112 has a bolt front end 116 and an opposing end 118. The second member 114 has a bolt handle 120.

Figure 5:
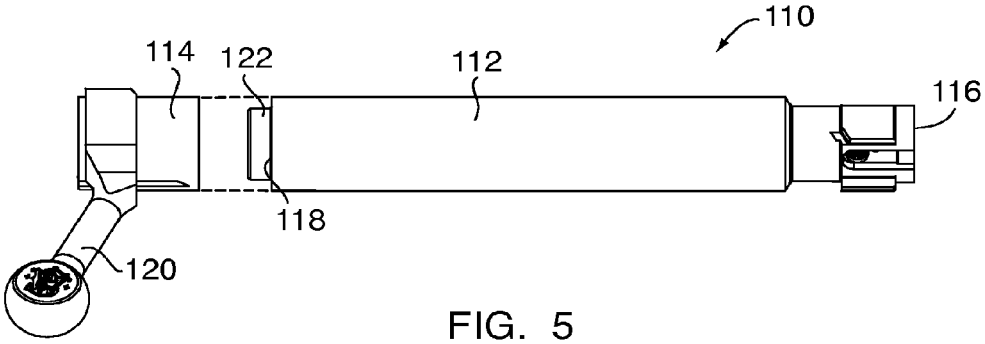
FIG. 5 is a simplified schematic exploded side view of the bolt of FIG. 4.
Figure 7:
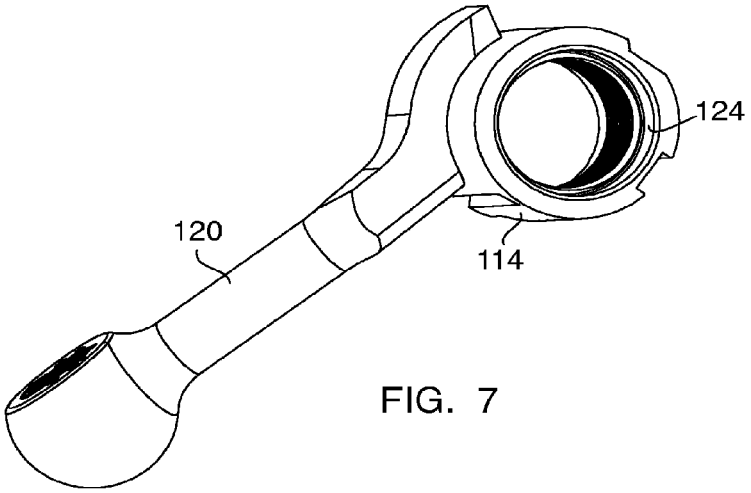
FIG. 7 is a simplified schematic illustration of the second member of the bolt of FIG. 4.

As shown in FIG. 5, an interior flange 122 is located at the opposing end 118 of the first member 112. The interior flange 122 fits inside a corresponding recess 124 of the second member 114 (shown in FIG. 7). The interior flange 122 is recessed from the outer surface of the main body 112 and also stands proud from the opposing end 118.

Figure 6:
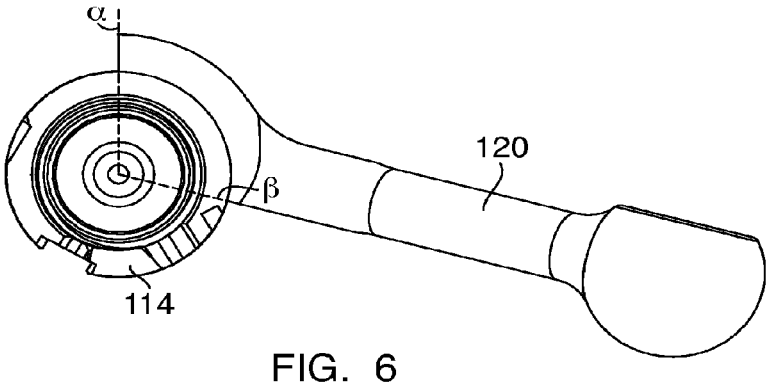
FIG. 6 is a simplified schematic end view of the second member of the bolt of FIG. 4.

The interior flange 122 of the first member 112 is brazed to the corresponding recess 124 of the second member 114. This design allows for a full 360-degree brazed joint. In contrast, prior mufti-piece bolts had a separate brazed handle. The brazed handle was joined to only a portion of the circumference of the bolt. For example, FIG. 6 shows the second member 114 of the present invention, which is machined out of a single piece so that the extension 120 does not have to be brazed onto the bolt. However, prior art bolts have a brazed handle, which would only be attached to a partial circumference of the bolt (shown as the small circumference between dashed lines .alpha. and .beta. in FIG. 6). In contrast, the brazed joint of the present invention is the full circumference of the interior flange 122 and its corresponding recess 124, which creates a stronger bolt 110.

As will be readily appreciated, the bolt 110 moves axially and translates about an axis of the bolt 110. By using a brazed joint over the full circumference of the interior flange 122 and its corresponding recess 124, which are also configured centrally about an axis of the bolt 110, the amount of torque applied to the brazed joint is significantly reduced when compared to known brazed joints on bolts where the bolt handle is attached over only a portion of the circumference of the bolt. The strength of the bolt is also increased since the supplemental body engages the main body over three separate surfaces. Specifically, the three surfaces are the outer surface of the interior flange 122, the end surface of the opposing end 118, and the end surface of the interior flange 122.

Creating the second member 114 with the bolt handle 120 creates a stronger handle. The brazed joint now covers the full circumference of the bolt 110 around interior flange 120. In contrast, previous attempts only had a brazed joint that covered a fraction of the circumference of the bolt, which resulted in the forces on the brazed joint being magnified from the axial forces exerted on the handle. These forces are not present on the brazed joint when it is located over the entire circumference of the bolt 110.

It is therefore an important aspect of the present invention that the bolt consists of two separate pieces. With this configuration, the bolt is less expensive to manufacture and has a stronger extension handle.

Figure 8:
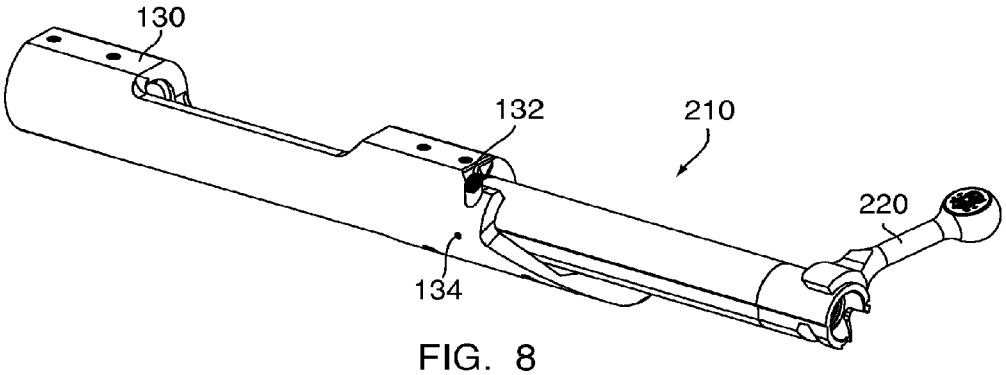
FIG. 8 is a simplified schematic side view of a takedown assembly provided in accordance with the present invention.
Figure 9:
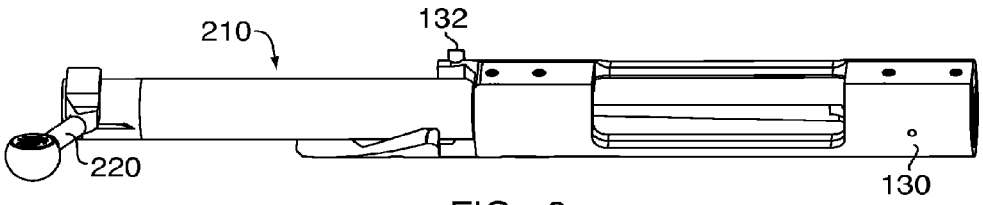
FIG. 9 is a simplified schematic side view of the takedown assembly of FIG. 8.
Figure 11:
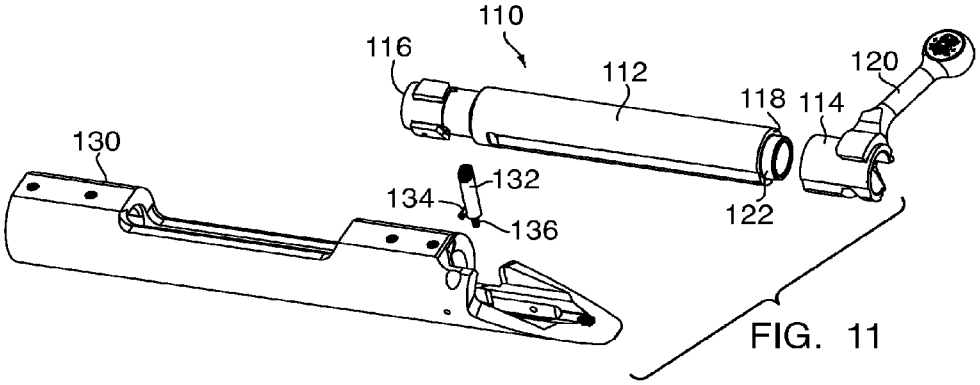
FIG. 11 is a simplified schematic exploded side view of the takedown assembly of FIG. 8.

FIGS. 8, 9, and 11 show another embodiment of the present invention in a simplified schematic form. Specifically, it shows components for a takedown assembly. In FIG. 8, a bolt 210 with a bolt handle 220 is enclosed within a receiver 130 and is adapted to slide forward and rearward within the receiver 130.

The receiver 130 contains two holes, which operably mount a rod 132 and a pin 134. The pin 134 keeps the rod 132 in place. The rod 132 operably engages with the bolt 210.

Figure 10:
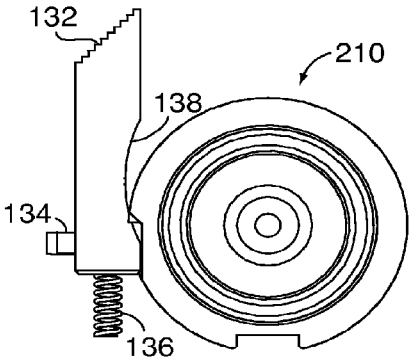
FIGS. 10 and 10A are simplified schematic views of a bolt and rod engagement of the takedown assembly of FIG. 8.
Figure 10A:
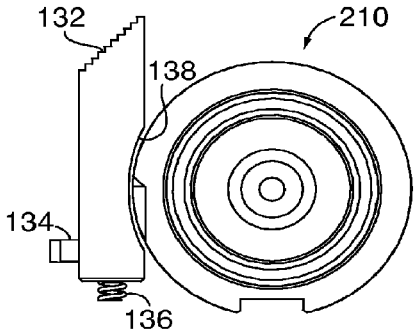

As shown in FIG. 10, the rod 132 is spring mounted on its lower end by spring 136. The pin 134 keeps the rod 132 in its proper position. When the spring 136 is in its relaxed position, the recessed area 138 is slightly displaced from the bolt 210 so as to prevent the bolt 210 from being removed. As shown in FIG. 10A, when the user depresses the rod 132 downward, the spring 136 is forced down and the recessed area 138 now matches the circumference of the bolt 210 so that the bolt 210 can be removed from the receiver 130.

The present invention allows the bolt 210 to be rearwardly removable from a firearm by simply pressing the rod 132 on the side of the receiver 130. Current designs provide a pin, which keeps the bolt in place. However, this pin can be difficult to remove and replace and is easily misplaced. The present invention overcomes these disadvantages by featuring a rod 132, which allows the bolt 210 to be easily removed, as well as the rod 132 with the pin 134 and the spring 136 to always be contained within the receiver 130.

It is therefore an important aspect of the present invention that the bolt-action firearm has a rearwardly removable bolt that can be completely removed from the firearm by simply pressing a rod on the side of the receiver.

Although the takedown assembly has mostly been described using a standard bolt 210, FIG. 11 further illustrates that the takedown assembly can be equally applied to the two-piece bolt 110 as described above.

Figure 12:
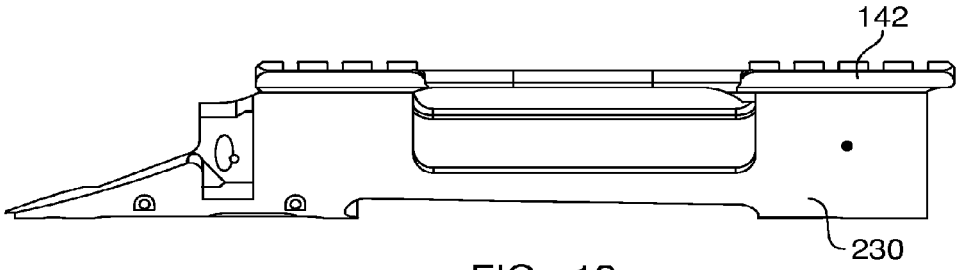
FIG. 12 is a simplified schematic side view of a scope mount provided in accordance with the present invention.
Figure 13:
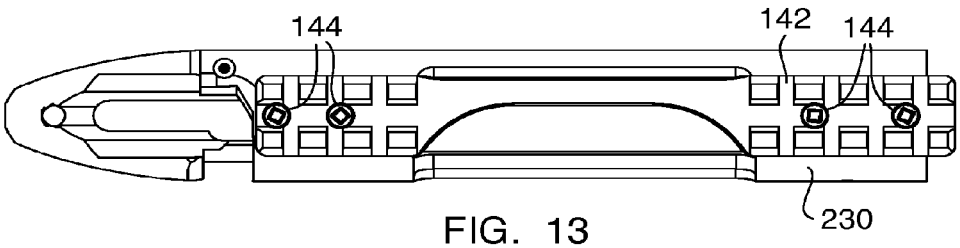
FIG. 13 is a simplified schematic top view of the scope mount of FIG. 12.
Figure 14:
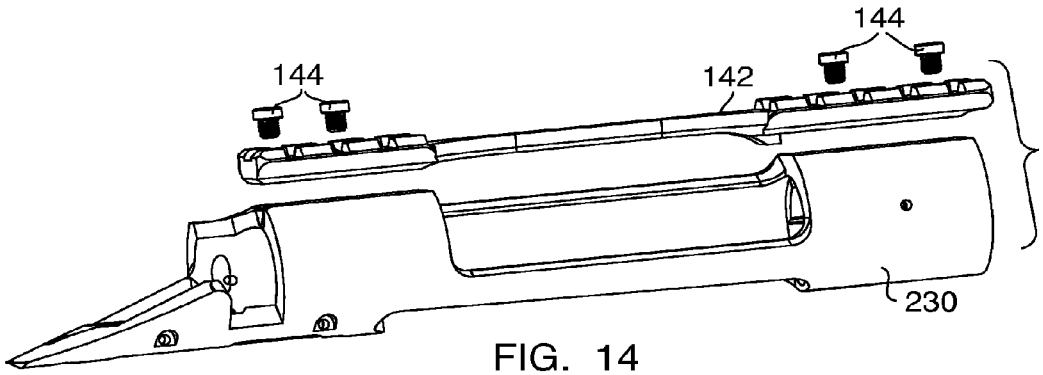
FIG. 14 is a simplified schematic exploded side view of the scope mount of FIG. 12.

FIG. 12 shows another embodiment of the present invention in a simplified schematic form. Specifically, it shows a scope mount 142. In FIG. 12, the scope mount 142 is removedly affixed to the top surface of the receiver 230 by an attachment means. As shown in FIGS. 13 and 14, the scope mount 142 is attached to the receiver 230 by nuts 144.

As can best be seen in FIG. 13, the scope mount 142 substantially covers the top surface of the receiver 230. The central region of the scope mount 142 is narrowed so that the ejection port of the receiver 230 is not significantly blocked in order to allow a cartridge to be easily fed into the receiver 230. In other words, the central region is in substantial registration with the ejection port. The geometry of the central region of the scope mount 142 is configured to allow a cartridge to be inserted into and ejected from the ejection port, which is located substantially on one side of the receiver 230.

Figure 15:
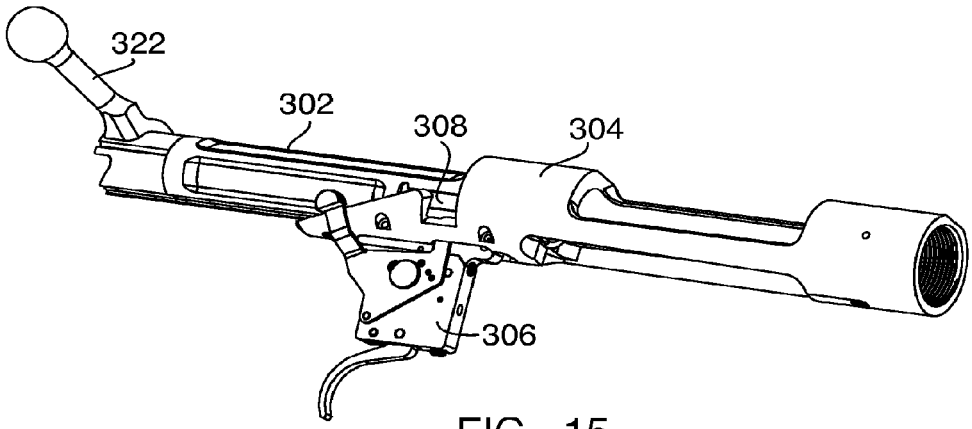
FIG. 15 is a perspective view of a bolt and receiver equipped with a buttonless stop in accordance with an embodiment of the present invention.

FIG. 15 is a perspective view of a bolt 302 equipped with a buttonless stop according to an embodiment of the present invention. As shown, the bolt 302 is located in the receiver 304 of the firearm and is shown in a retracted position. A portion of the trigger mechanism 306 and the sear (not shown) are also located within the receiver 304 as illustrated in the figure. The bolt 302 has a groove or channel 308 machined into its surface, which allows the bolt 302 to be urged forward to load a cartridge into the receiver 304 and be retracted to remove a spent cartridge. Significantly, the channel 308 also allows the bolt 302 to be completely removed from the receiver 304 and the firearm (not shown).

While FIG. 15, and the other figures, depicts a two-piece bolt as described above, it will be readily apparent that the present invention can be used with one-piece bolts as well.

Figure 16:
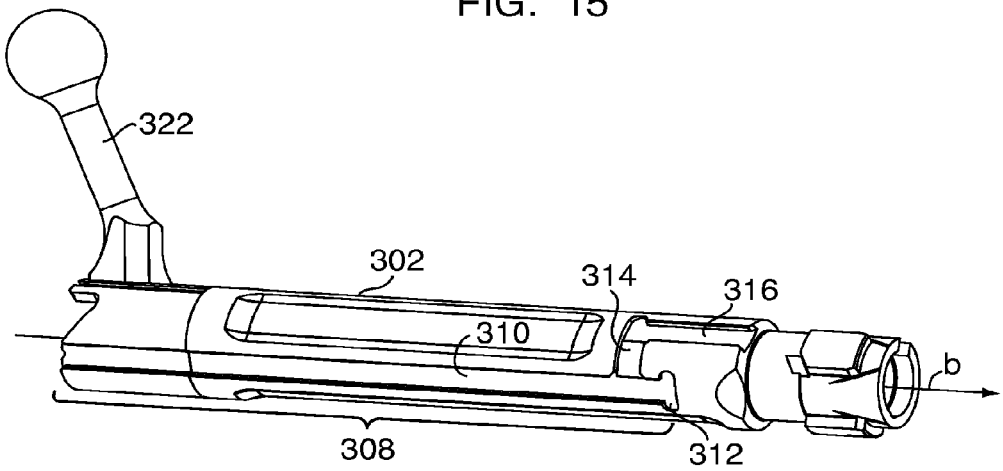
FIG. 16 is a simplified perspective view of the buttonless stop of FIG. 15.

Turning now to FIG. 16, the channel 308 has several connected sections. Specifically, the channel 308 has a first channel section 310 that is generally perpendicular to bolt axis b of the firearm. The first channel section 310 terminates in an abutment surface or stop 312. The stop 312 limits the rearward travel of the bolt 302 when it is retracted to remove a cartridge. Further, channel 308 has a second channel section 314 that is connected to the first channel section 310. The second channel section 314 is generally perpendicular to the first channel section 310. The second channel section 314 allows the bolt 302 to be rotated so that it may subsequently be removed. Finally, the second channel section 314 is connected with a third channel section 316 which is generally perpendicular to the second section 314 and parallel to the first section 310. The third channel section 316 does not terminate in a stop and allows the bolt 302 to be slidably removed from the receiver.

As will be appreciated, the channel 308 and its sections 310, 314, and 316 are important aspects of the present invention. The channel 308 allows the bolt 302 to be urged forward and rearward to load and remove a cartridge respectively. The second channel section 314 also allows the bolt 302 to be rotated about bolt axis b and then be removed from the firearm via the third channel section 316. As discussed in greater detail below, the specific configuration and orientation of the channel 308 eliminates the need for a button or lever to remove the bolt 302.

Figure 19:
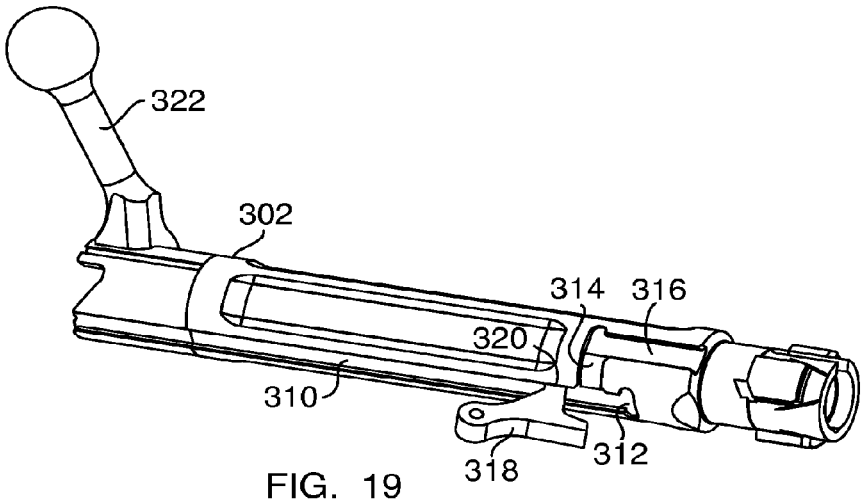
FIG. 19 is a simplified perspective bottom view of the buttonless stop of FIG. 18 illustrating the interaction between the sear and a channel of the bolt.
Figure 17:
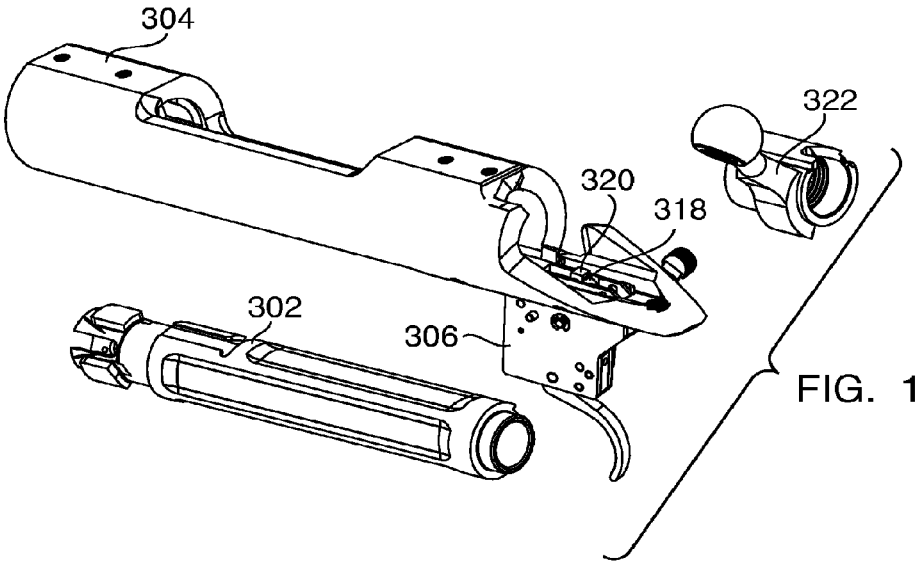
FIG. 17 is a partially exploded rear perspective view of the buttonless stop of FIG. 15.
Figure 18:
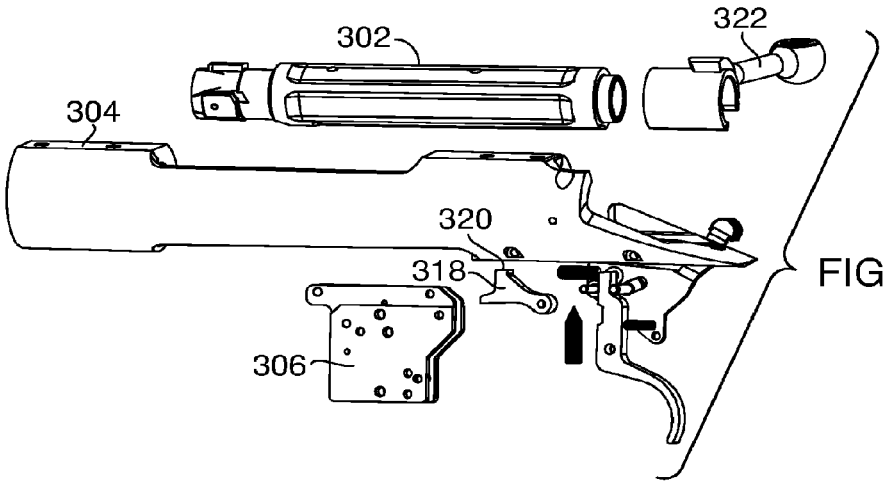
FIG. 18 is an exploded side view of the buttonless stop of FIG. 15 depicting individual components of a sear assembly.

Turning to FIGS. 17-19, an upper portion 320 of the firearm sear 318 engages the channel sections 310, 314, 316 and guides the movement of the bolt 302. As shown in FIG. 17, an upper sear portion 320 protrudes slightly into the receiver 304 and into the channel (not shown). The engagement of the upper sear portion 320 and the channel sections 310, 314, 316 is illustrated in FIG. 19, which is a simplified perspective view of the inventive bolt 302 and sear 318. As will be appreciated, the bolt 302 slides rearward and forward, relative to the firearm, about the upper sear portion 320 when the portion 320 is in channel sections 310 and 316. The bolt can also be rotated about the bolt axis b when the upper sear portion 320 travels in the second channel section 314.

To remove the bolt 302, a user retracts the bolt 302 via the bolt handle or extension 322 until the upper sear portion 320 contacts the stop 312 at the end of the first channel section 310. The bolt 302 is then urged forward slightly until the second channel portion 314 is aligned with the upper sear portion 320. Once aligned, the bolt 302 may then be rotated about bolt axis b in direction d until the upper sear portion 320 is aligned with the third channel portion 316. As stated, the third channel portion 316 does not have a stop or abutment surface at its terminal end and allows the bolt 302 to be completely removed from the sear 318 and the receiver (not shown).

As will be readily apparent, the channel 308 and upper sear portion 320 are important aspects of the present invention as they allow the bolt 302 to be removed without the need for a button or lever. The inventive buttonless stop thereby reduces manufacturing and assembly costs, as additional components, machining, and assembly are not required. Moreover, the inventive stop does not require the stocking of replacement parts, e.g., levers or biasing means, as none are needed apart from the actual bolt 302 and sear 318.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A firearm, comprising:

a stock;

a receiver mounted on said stock, said receiver having a threaded portion at a forward end thereof;

a barrel affixed to said forward end of said receiver, said barrel having a threaded portion engaged with said threaded portion of said receiver;

a crush washer having a smooth surface defining a bore for receiving said threaded portion of said barrel, said crush washer further having a recoil lug extending therefrom, said crush washer being located between said barrel and said receiver when said threaded portion of said barrel is received within said bore; and wherein said barrel is threadedly adjustable about said crush washer.

2. The firearm of claim 1, wherein said crush washer is compressed and deformed between said barrel and said receiver.

3. The firearm of claim 1, wherein said threaded portion of said barrel comprises external threads.

4. A receiver assembly for a firearm, said receiver assembly comprising:

a threaded portion at a forward end thereof;

a barrel affixed to said forward end of said receiver, said barrel having a threaded portion engaged with said threaded portion of said receiver;

a crush washer having a smooth surface defining a bore for receiving said threaded portion of said barrel, said crush washer further having a recoil lug extending therefrom, said crush washer being located between said barrel and said receiver when said threaded portion of said barrel is received within said bore; and wherein said barrel is threadedly adjustable about said crush washer.

5. The receiver assembly of claim 4, wherein said crush washer is compressed and deformed between said barrel and said receiver.

6. The receiver assembly of claim 4, wherein said threaded portion of said barrel comprises external threads.

7. The receiver assembly of claim 4, further comprising a bolt movably mounted on said receiver.

* * * * *